US006511238B1

(12) United States Patent
Glize

(10) Patent No.: US 6,511,238 B1
(45) Date of Patent: Jan. 28, 2003

(54) CASSETTE WITH CONSUMABLE TAPE, IN PARTICULAR FOR TRANSPORT TICKET PROCESSING DEVICE

(75) Inventor: Jean-Pierre Glize, Chatou (FR)

(73) Assignee: Dassault Automatismes et Telecommunications, Plaisir (FR)

( * ) Notice: Subject to any disclaimer, the term of this patent is extended or adjusted under 35 U.S.C. 154(b) by 0 days.

(21) Appl. No.: 09/786,351

(22) PCT Filed: Jul. 11, 2000

(86) PCT No.: PCT/FR00/02003

§ 371 (c)(1),
(2), (4) Date: Apr. 12, 2001

(87) PCT Pub. No.: WO01/03940

PCT Pub. Date: Jan. 18, 2001

(30) Foreign Application Priority Data

Jul. 13, 1999 (FR) ..... 99 09100

(51) Int. Cl.[7] ..... B41J 32/00; B41J 35/28; B41J 33/14

(52) U.S. Cl. ..... 400/234; 400/194; 400/196; 400/207

(58) Field of Search ..... 400/194, 196, 400/207, 234

(56) References Cited

U.S. PATENT DOCUMENTS 3,923,141 A 12/1975 Hengelhaupt
4,074,799 A * 2/1978 Hishida et al. ..... 197/151
4,368,992 A * 1/1983 Gagnebin ..... 400/196
5,000,397 A * 3/1991 Darrieux ..... 242/156
5,127,750 A 7/1992 Burgin
5,429,443 A * 7/1995 Kobayashi et al. ..... 400/229
5,667,318 A * 9/1997 Tanno et al. ..... 400/208
5,741,081 A * 4/1998 Yamamoto et al. ..... 400/234
5,857,786 A * 1/1999 Randolph ..... 400/234

FOREIGN PATENT DOCUMENTS

| | | |
|---|---|---|
| DE | 39 27 421 | 2/1991 |
| EP | 0 703 089 | 3/1996 |
| EP | 0 894 635 | 2/1999 |

* cited by examiner

*Primary Examiner*—Daniel J. Colilla
*Assistant Examiner*—Marvin P Crenshaw
(74) *Attorney, Agent, or Firm*—Oblon, Spivak, McClelland, Maier & Neustadt, P.C.

(57) ABSTRACT

The invention concerns a replaceable cassette comprising first and second rotary rollers (BO1 and BO2) on each of which is wound a tape (RE) from one of its ends, each roller (BO1 and BO2), being capable of being locked on a receiving apparatus spindle drive. The cassette comprises a mechanism tensioning the tape, capable, when the cassette is outside the receiving apparatus, of maintaining said tape constantly stretched even if an impact, a change in temperature, a mechanical stress or the like occurs.

14 Claims, 2 Drawing Sheets

Figure 1:
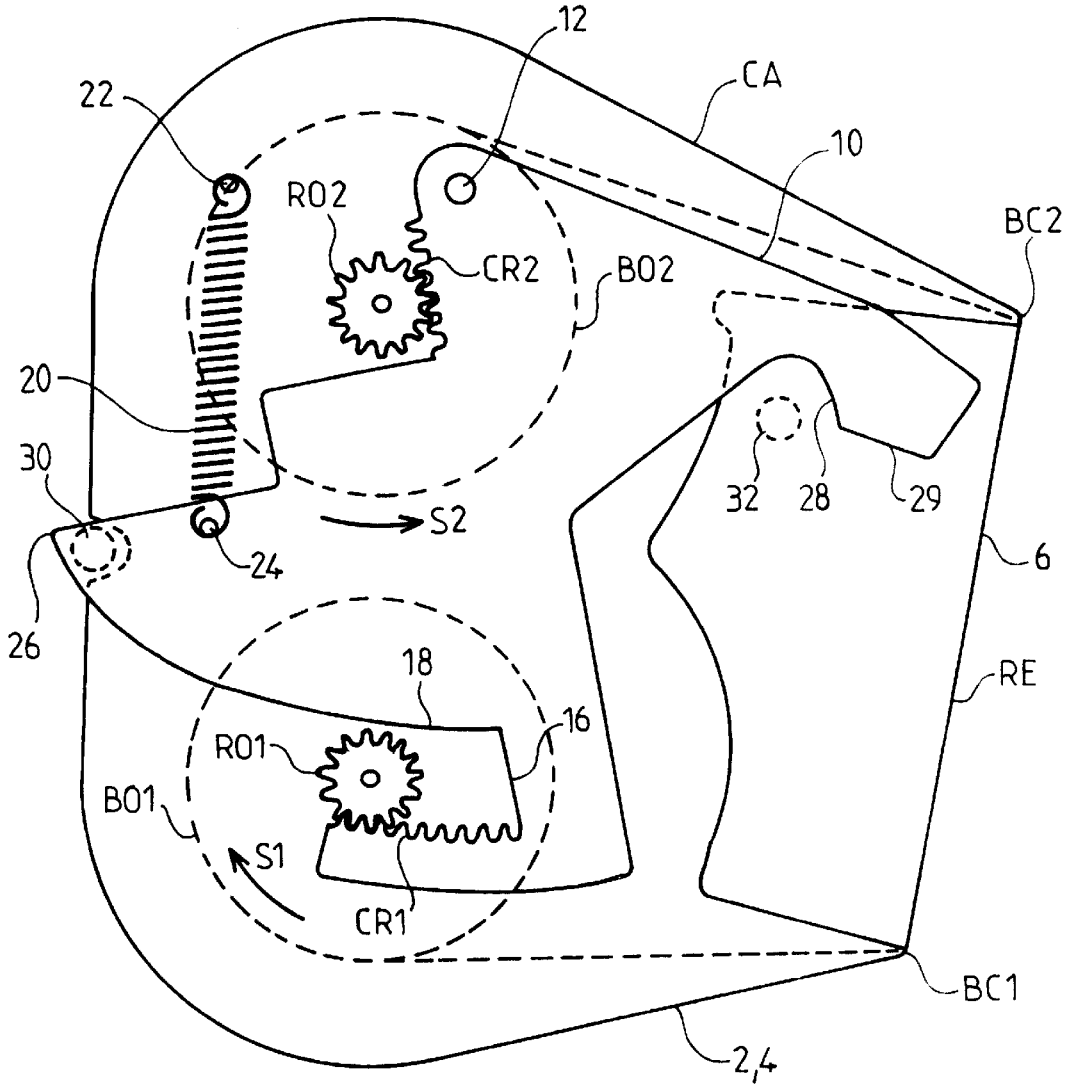

CASSETTE WITH CONSUMABLE TAPE, IN PARTICULAR FOR TRANSPORT TICKET PROCESSING DEVICE

The present invention relates to a cassette with consumable tape, in particular for transport ticket processing device.

It has a general application for consumable tape, and more particularly for inking tape used in particular for thermal printing, for example, for processing transport tickets.

Cassettes with consumable tape are already known. In the International Application published with no. WO 96/11872, a replaceable cassette comprises a carcass supporting rotatably two reels on each of which is wound a tape from one of its ends, each reel comprising an axial bore in order to be fitted on to a spindle of a ticket processing device intended to receive the cassette.

The cassette comprises disengageable locking means to prevent each reel from turning in the direction of slackening of the tape. Before mounting of the cassette, these disengageable means keep the two reels in a position where the tape is taut in the region where it must be positioned relative to the thermal printing device.

In practice, the disengageable locking means comprise two toothed discs (one per reel) and two ratchets each cooperating with the toothing of one of the discs in order to prevent rotation of the corresponding reel in the direction of slackening of the exposed region of tape. The two ratchets are opposite one another and are formed as a single spring blade with an actuating region joining them. When the two ratchets are in an active position, each reel can only turn in one direction, contrary to that allowed for the other reel, and corresponding to an increase in tension of the exposed region of the tape.

During manufacture of the cassette, a reasonable tension is imparted to the tape and in particular to its exposed region, and this tension is maintained during transport, storage and fitting of the cassette by virtue of the disengageable locking means, which remain active throughout this period.

Such locking means are not totally satisfactory. In fact, the tape may slacken, for example, due to changes in temperature and impacts which may arise during transport or storage of the cassette. This slackening of the tape cannot be compensated, since the reels are locked in a fixed position. Consequently, insertion of the cassette into the receiving device may be interfered with, sometimes to the point of damage to the tape.

Moreover, the locking position of the reels depends on the play of the toothing of the wheels cooperating with the ratchets, which makes such locking imperfect.

Finally, the disengagement of the locking means is generally effected by an operator, and this manual operation is generally difficult to carry out.

The present invention brings a solution to these problems.

It relates to a replaceable tape comprising first and second rotating reels on each of which is wound a tape starting from one of its ends, each reel being capable of fitting over a spindle of a receiving apparatus.

According to a general definition of the invention, the cassette comprises a mechanism for tensioning the tape, capable, when the cassette is outside the receiving apparatus, of keeping the tape taut in a substantially constant manner even in the case of impact, change of temperature, mechanical stress or the like.

Thus, by virtue of the tensioning mechanism of the tape according to the invention, the tape is kept constantly taut even in the case of impacts or changes of temperature during transport, storage or fitting of the cassette in the receiving apparatus.

According to a first embodiment of the invention, the mechanism of the invention comprises:

- first means of driving rotatably the first reel in a first direction,
- locking means capable of rendering non-rotatable the second reel, and
- means forming a resilient recall, capable when the cassette is outside the receiving apparatus of applying a stress to the first drive means and to the locking means, such that with the second reel locked, the first drive means drive rotatably the first reel until the tape reaches a selected position of tension, the stress of the means forming a resilient recall, making it possible to keep the tape taut according to the selected tension position, whatever the conditions of transport, storage, impact, temperature, mechanical stress or the like.

According to a second embodiment of the invention, the mechanism of the invention comprises:

- first means for driving rotatably the first reel in a first direction,
- second means for driving rotatably the second reel in a second direction, contrary to the first direction,
- means forming a resilient recall, capable, when the cassette is outside the receiving apparatus, of applying a stress to the first and second drive means, such that the first and second drive means drive rotatably respectively the first and second reel in their respective directions until any slack in the tape is compensated and the tape is brought into a selected tension position, the stress of the means forming a resilient recall making it possible to keep the tape taut according to the selected tension position, whatever the conditions of transport, storage, impact, temperature, mechanical stress or the like.

Figure 2:
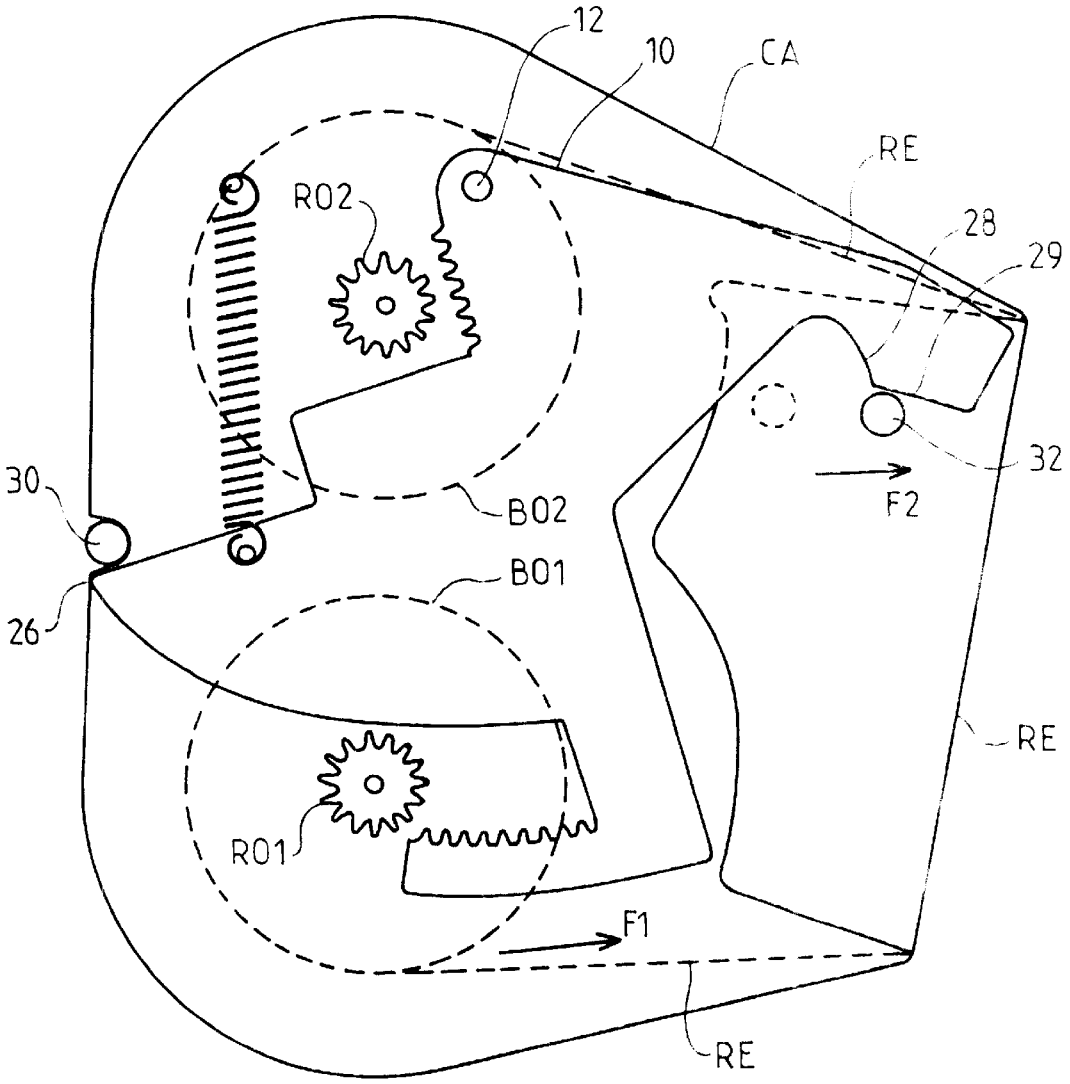

Further features and advantages of the invention will appear from the detailed description below and from the drawings, which show:

FIG. 1, a diagrammatic, partial front view of the cassette, showing the tape tensioning mechanism before insertion of the cassette in a receiving apparatus, according to the invention; and FIG. 2 a front view of the cassette, showing the clutch of the tape tensioning mechanism at the time when the cassette is inserted into the receiving apparatus, according to the invention.

These drawings comprise elements of a definite character. As such, they may not only give a better understanding of the invention, but contribute to the definition thereof.

By way of non-limiting illustration, the cassette according to the invention is intended to fit on to spindles supported by a ticket processing device of the type described in the International Application filed by the present Applicants on Jun. 17, 1999 with the no. PCT/FR 99/01465 with the title "Ticket processing device, with thermal printing and magnetic inscription/reading along a closed circuit internal path". For information, this International Application forms an integral part of the description of the present invention.

With reference to FIG. 1, the cassette CA comprises a carcass composed of two end plates 2 and 4 fixed together by lateral walls (not shown). In the cassette CA, an inking tape RE is wound from a first end on to one of the reels BO1 and from the other end on to the other reel BO2. From each reel BO, the tape RE follows a path up to the end of a respective tip BC1, BC2 defined by the cassette CA. Between the two tips BC1 and BC2, a region 6 of the tape RE is exposed for use.

The ticket processing device intended to receive the cassette generally comprises two spindles (not shown) supported rotatably in the ticket processing device about parallel axes of rotation. Each spindle is intended to fit into the two tubular reels BO1 and BO2 supported rotatably about parallel axes in the cassette carcass. The cassette may be mounted exchangeably in the ticket processing device.

Each reel BO1, BO2 comprises a respective toothed wheel RO1, RO2. Each reel BO comprises an axial cylindrical bore defined over the larger part of its length by a tube of substantially rigid plastics material. The tube also defines the entirety of the external surface of the reel as well as, in a single piece, the wheels RO1 and RO2.

Each reel is driven rotatably via at least one retractable key forming part of the ticket processing device spindle and cooperating with at least one groove formed in the bore of each reel.

According to the invention, a tape tensioning mechanism is provided.

The tape tensioning mechanism comprises the two toothed wheels RO1 and RO2 (one per reel), two racks CR1 and CR2, each cooperating with the toothing of one of the wheels RO1 and RO2. The two racks are carried by a plate 10. The plate 10 is movable rotatably relative to the carcass, about an axis of rotation 12.

In practice, the rack CR1 has a generally curved shape, e.g. as an arc of a circle, centred relative to the axis 12. The rack CR1 is mobile rotatably about the axis 12. The rack CR1 has a toothed sector of a length permitting rotation of the wheel RO1 in the direction S1 in order to take up any slack in the tape.

The toothed wheel RO1 is intended to be housed in a space defined by the rack CR1, a stop 18 parallel to the rack CR1, diametrically opposite the rack CR1 and connected to the same by a section of the plate 16.

According to a first embodiment of the mechanism according to the invention, the rack CR2 is rectilinear and can be limited to a single tooth. The function of the rack CR2 is then to render the reel BO2 non-rotatable. The rack CR2 may be replaced by a ratchet or a tappet intended to mesh with the toothed wheel RO2 in order to lock the same. When the two racks CR1 and CR2 are in the active position shown in FIG. 1, the reel BO2 is non-rotatable, whereas the reel BO1 is capable of rotating on itself along the rack CR1, the rack CR1 rotating about the axis of rotation 12 in the direction S1.

In a second embodiment of the mechanism according to the invention, the rack CR2 is similar to the rack CR1. Thus the rack CR2 is curved and comprises a toothed sector of selected length. The function of a curved rack CR2 is to drive the reel BO2 rotatably in the direction S2 opposite to that S1 of the rack CR1 in order to take up any slack in the tape.

According to the invention, a spring 20 is provided to keep the tape substantially taut in a selected position of tension corresponding preferably to a reasonable tension of the tape.

The spring 20 comprises an end 22 rigidly connected to the cassette and an end 24 rigidly connected to the plate 10.

The spring 20 makes it possible to transmit, via the plate 10, a torque to at least one of the reels, in this case at least the reel BO1, whereas the reel BO2 is locked (in the case of a rack CR2 with one tooth or of rectilinear shape) or rotatable (in the case of a curved rack CR2).

The spring forms an energy reserve whose energy is capable of being applied in order to keep the tape taut, whatever the conditions of transport, storage, impact, mechanical stress or change of temperature capable of being applied to the tape.

Preferably, the axis of rotation 12 is disposed close to the receiving reel BO2 of the tape and remote from the tape output reel BO1. It should be noted that the spring 20 forms a resilient recall which can be replaced by a deformable blade of the same material as the plate, of a section and shape adapted to permit deformation under a given stress (in this case rotation).

With reference to FIG. 1, the plate 10 additionally comprises a tip 36 as well as a concave portion 28 followed by a shoulder 29.

FIG. 2 shows the insertion of the cassette described with reference to FIG. 1 into a receiving device, in this case a ticket processing device such as described in the above-mentioned International Application filed in the name of the Applicant.

In practice, the ticket processing device comprises a fixed tappet 30. This tappet 30 is a locking tappet which locks the mechanism for keeping the tape taut, in particular the plate 10 in a disengaged position until the next removal of the cassette.

The ticket processing device further comprises a moving tappet 32. The displacement of the moving tappet 32 is effected in the direction indicated by the arrow F2. This displacement causes the plate 10 to rotate in the direction of the arrow F1 until the tip 26 passes under the tappet 30 which is holding the plate 10 in this disengaged position.

The moving tappet 32 is actuated in the direction indicated by the arrow F2 when, for example, the cover of the ticket processing device is closed again or when the printing head is pivoted into the "print" position.

The movement of the tappet 32 corresponds to disengagement of the mechanism for keeping the tape taut according to the invention and to prestressing of the spring ready for the next extension thereof. Thus, when the moving tappet 32 is in the position described with reference to FIG. 2, in dot-dash lines, the plate 10 is held in position by the locking tappet 30. Removal of the cassette from the ticket processing device causes retraction of the tappet 30 (rigidly connected to the ticket processing device) and actuation of the plate 10, which carries out tensioning of the tape. The position of the tappet 32 shown in solid lines corresponds to the disengaged position of the plate.

The modus operandi relating to insertion of the cassette into the processing device is as follows.

First of all, the cassette is fitted on to the two spindles of the ticket processing device.

The tappet 32 is in the rest position, shown in dot-dash lines in FIG. 2. The cover of the processing device is then pulled down, and the tappet 32 moves from its rest position towards its operating position, as shown by the arrow F2.

This displacement causes the plate 10 to rotate in the direction F1 (anti-clockwise direction).

This displacement causes prestressing of the locking tappet 30, which locks the plate 10 in a position such that the wheels RO1 and RO2 are freely rotatable. Thus the tape can move past in the processing device. Locking of the plate is such that printing is carried out correctly, without hindrance from the plate.

In order to remove the cassette from its defined housing in the ticket processing device, the cassette must be removed from its spindles, which causes locking of the tappet 30 to be cancelled and the plate 10 to rotate in a clockwise direction (opposite to direction F1).

The spring generates a torque which causes the plate 10 to rotate in a clockwise direction. The tape is kept taut with a substantially constant tension, whatever the conditions or stresses applied to the cassette in the field of transport, storage or the presence of special conditions, in particular of temperature or mechanical stresses (acceleration).

Thus the spring applies a tension stress to the tape which is directly proportional to the stress of the spring. This spring stress is insensitive to impacts (in the field of transport or storage of the cassette) and to changes in temperature or mechanical stresses capable of generating expansion or slackening of the tape.

It should be noted that the disengagement of the mechanism for keeping the tape taut according to the invention is a quasi-automatic operation, commanded for example by closure of the cover of the ticket processing device or by a control electromagnet of the printing head.

In practice, the plate 10 is formed of plastics material. As a modification, the plate may be replaced by any means capable of driving at least one toothed wheel, for example a toothed belt or chain.

What is claimed is:

1. A replaceable cassette comprising:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism for maintaining said tape in a taut state, wherein said mechanism for maintaining said tape in said taut state includes first drive means for rotatably driving said first rotating reel in a first direction, such that when said cassette is outside of and not received in the receiving apparatus, said mechanism for maintaining said tape in said taut state, maintains said tape in said taut state in a substantially constant manner even during conditions of any one of a group consisting of transport, storage, impact, change of temperature, and mechanical stress, wherein said mechanism for maintaining said tape in said taut state further includes:

locking means for preventing said second rotating reel from rotating; and means for forming a resilient recall, such that when said cassette is outside of and not received in the receiving apparatus, said means for forming said resilient recall applies a stress to said first drive means and to said locking means, and such that when said second rotating reel is prevented from rotating by said locking means, said first drive means rotatably drives said first rotating reel until said tape reaches a preselected position of tension, said stress of said means for forming said resilient recall aiding in maintaining said tape in said taut state according to said preselected position of tension of said tape, regardless of said conditions of any one of said group consisting of transport, storage, impact, change of temperature, and mechanical stress, wherein each of said first and second rotating reels includes a toothed wheel and said locking means includes at least one tooth for preventing said toothed wheel of said second rotating reel from rotating.

2. A replaceable cassette comprising:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism for maintaining said tape in a taut state, wherein said mechanism for maintaining said tape in said taut state includes first drive means for rotatably driving said first rotating reel in a first direction, such that when said cassette is outside of and not received in the receiving apparatus, said mechanism for maintaining said tape in said taut state, maintains said tape in said taut state in a substantially constant manner even during conditions of any one of a group consisting of transport, storage, impact, change of temperature, and mechanical stress, wherein said mechanism for maintaining said tape in said taut state includes:

second means for rotatably driving said second rotating reel in a second direction, contrary to said first direction;

means for forming a resilient recall, such that when said cassette is outside of and not received in the receiving apparatus, said means for forming said resilient recall applies a stress to said first and second drive means, and said first and second drive means rotatably drive said first and second rotating reels, respectively, in said first and second directions, respectively, until any slack in said tape is compensated for and said tape is brought into a preselected position of tension, said stress of said means for forming said resilient recall aiding in maintaining said tape in said taut state according to said preselected position of tension, regardless of said conditions of any one of said group consisting of transport, storage, impact, change of temperature, and mechanical stress.

3. The replaceable cassette according to claim 2, wherein each of said first and second rotating reels includes a toothed wheel, and wherein said first means for rotatably driving said first rotating reel in said first direction includes a curved rack, said curved rack being rotatable about an axis of rotation.

4. The replaceable cassette according to claim 4, wherein any one of a group consisting of said locking means and said first and second drive means are carried by a plate, said plate being rotatable about an axis of rotation.

5. A replaceable cassette comprising:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism for maintaining said tape in a taut state, wherein said mechanism for maintaining said tape in said taut state includes first drive means for rotatably driving said first rotating reel in a first direction, such that when said cassette is outside of and not received in the receiving apparatus, said mechanism for maintaining said tape in said taut state, maintains said tape in said taut state in a substantially constant manner even during conditions of any one of a group consisting of transport, storage, impact, change of temperature, and mechanical stress, wherein said mechanism for maintaining said tape in said taut state further includes:

locking means for preventing said second rotating reel from rotating; and means for forming a resilient recall, such that when said cassette is outside of and not received in the receiving apparatus, said means for forming said resilient recall applies a stress to said first drive means and to said locking means, and such that when said second rotating reel is prevented from rotating by said locking means, said first drive means rotatably drives said first rotating reel until said tape reaches a preselected position of tension, said stress of said means for forming said resilient recall aiding in maintaining said tape in said taut state according to said preselected position of tension of said tape, regardless of said conditions of any one of said group consisting of transport, storage, impact, change of temperature, and mechanical stress, wherein each of said first and second rotating reels include a toothed wheel, and wherein said first means for rotatably driving said first rotating reel includes a curved rack, said curved rack being rotatable about an axis of rotation.

6. A replaceable cassette comprising:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism for maintaining said tape in a taut state, wherein said mechanism for maintaining said tape in said taut state includes first drive means for rotatably driving said first rotating reel in a first direction, such that when said cassette is outside of and not received in the receiving apparatus, said mechanism for maintaining said tape in said taut state, maintains said tape in said taut state in a substantially constant manner even during conditions of any one of a group consisting of transport, storage, impact, change of temperature, and mechanical stress, wherein said mechanism for maintaining said tape in said taut state further includes:

locking means for preventing said second rotating reel from rotating; and means for forming a resilient recall, such that when said cassette is outside of and not received in the receiving apparatus, said means for forming said resilient recall applies a stress to said first drive means and to said locking means, and such that when said second rotating reel is prevented from rotating by said locking means, said first drive means rotatably drives said first rotating reel until said tape reaches a preselected position of tension, said stress of said means for forming said resilient recall aiding in maintaining said tape in said taut state according to said preselected position of tension of said tape, regardless of said conditions of any one of said group consisting of transport, storage, impact, change of temperature, and mechanical stress, wherein any one of a group consisting of said locking means and said first and second drive means are carried by a plate, said plate being rotatable about an axis of rotation.

7. A tape-consuming apparatus and a replaceable cassette comprising:

said replaceable cassette including:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism for maintaining said tape in a taut state, wherein said mechanism for maintaining said tape in said taut state includes first drive means for rotatably driving said first rotating reel in a first direction, such that when said cassette is outside of and not received in the receiving apparatus, said mechanism for maintaining said tape in said taut state, maintains said tape in said taut state in a substantially constant manner even during conditions of any one of a group consisting of transport, storage, impact, change of temperature, and mechanical stress; and said tape-consuming apparatus receiving said cassette therein, said tape-consuming apparatus comprising:

a fixed tappet; and a moving tappet for actuating, in a direction of disengagement, means of said mechanism for maintaining said tape in said taut state.

8. A replaceable cassette comprising:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism configured to maintain said tape in a taut state, wherein said mechanism configured to maintain said tape in said taut state includes first drive mechanism configured to rotatably drive said first rotating reel in a first direction, such that when said cassette is outside of and not received in the receiving apparatus, said mechanism configured to maintain said tape in said taut state, maintains said tape in said taut state in a substantially constant manner even during conditions of any one of a group consisting of transport, storage, impact, change of temperature, and mechanical stress, wherein said mechanism configured to maintain said tape in said taut state further includes:

a locking mechanism configured to prevent said second rotating reel from rotating; and a mechanism configured to a resilient recall, such that when said cassette is outside of and not received in the receiving apparatus, said mechanism configured to form said resilient recall applies a stress to said first drive mechanism and to said locking mechanism, and such that when said second rotating reel is prevented from rotating by said locking mechanism, said first drive mechanism rotatably drives said first rotating reel until said tape reaches a preselected position of tension, said stress of said mechanism configured to form said resilient recall aiding in maintaining said tape in said taut state according to said preselected position of tension of said tape, regardless of said conditions of any one of said group consisting of transport, storage, impact, change of temperature, and mechanical stress, wherein each of said first and second rotating reels includes a toothed wheel and said locking mechanism includes at least one tooth configured to prevent said toothed wheel of said second rotating reel from rotating.

9. A replaceable cassette comprising:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism configured to maintain said tape in a taut state, wherein said mechanism configured to maintain said tape in said taut state includes first drive mechanism configured to rotatably drive said first rotating reel in a first direction, such that when said cassette is outside of and not received in the receiving apparatus, said mechanism configured to maintain said tape in said taut state, maintains said tape in said taut state in a substantially constant manner even during conditions of any one of a group consisting of transport, storage, impact, change of temperature, and mechanical stress, wherein said mechanism configured to maintain said tape in said taut state includes:

a second mechanism configured to rotatably drive said second rotating reel in a second direction, contrary to said first direction;

a mechanism configured to form a resilient recall, such that when said cassette is outside of and not received in the receiving apparatus, said mechanism configured to form said resilient recall applies a stress to said first and second drive mechanisms, and said first and second drive mechanisms rotatably drive said first and second rotating reels, respectively, in said first and second directions, respectively, until any slack in said tape is compensated for and said tape is brought into a preselected position of tension, said stress of said mechanism configured to form said resilient recall aiding in maintaining said tape in said taut state according to said preselected position of tension, regardless of said conditions of any one of said group consisting of transport, storage, impact, change of temperature, and mechanical stress.

10. The replaceable cassette according to claim 9, wherein each of said first and second rotating reels includes a toothed wheel, and wherein said first mechanism configured to rotatably drive said first rotating reel in said first direction includes a curved rack, said curved rack being rotatable about an axis of rotation.

11. The replaceable cassette according to claim 9, wherein any one of a group consisting of said locking mechanism and said first and second drive mechanisms are carried by a plate, said plate being rotatable about an axis of rotation.

12. A replaceable cassette comprising:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism configured to maintain said tape in a taut state, wherein said mechanism configured to maintain said tape in said taut state includes first drive mechanism configured to rotatably drive said first rotating reel in a first direction, such that when said cassette is outside of and not received in the receiving apparatus, said mechanism configured to maintain said tape in said taut state, maintains said tape in said taut state in a substantially constant manner even during conditions of any one of a group consisting of transport, storage, impact, change of temperature, and mechanical stress, wherein said mechanism configured to maintain said tape in said taut state further includes:

a locking mechanism configured to prevent said second rotating reel from rotating; and a mechanism configured to a resilient recall, such that when said cassette is outside of and not received in the receiving apparatus, said mechanism configured to form said resilient recall applies a stress to said first drive mechanism and to said locking mechanism, and such that when said second rotating reel is prevented from rotating by said locking mechanism, said first drive mechanism rotatably drives said first rotating reel until said tape reaches a preselected position of tension, said stress of said mechanism configured to form said resilient recall aiding in maintaining said tape in said taut state according to said preselected position of tension of said tape, regardless of said conditions of any one of said group consisting of transport, storage, impact, change of temperature, and mechanical stress, wherein each of said first and second rotating reels include a toothed wheel, and wherein said first mechanism configured to rotatably drive said first rotating reel includes a curved rack, said curved rack being rotatable about an axis of rotation.

13. A replaceable cassette comprising:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism configured to maintain said tape in a taut state, wherein said mechanism configured to maintain said tape in said taut state includes first drive mechanism configured to rotatably drive said first rotating reel in a first direction, such that when said cassette is outside of and not received in the receiving apparatus, said mechanism configured to maintain said tape in said taut state, maintains said tape in said taut state in a substantially constant manner even during conditions of any one of a group consisting of transport, storage, impact, change of temperature, and mechanical stress, wherein said mechanism configured to maintain said tape in said taut state further includes:

a locking mechanism configured to prevent said second rotating reel from rotating; and a mechanism configured to a resilient recall, such that when said cassette is outside of and not received in the receiving apparatus, said mechanism configured to form said resilient recall applies a stress to said first drive mechanism and to said locking mechanism, and such that when said second rotating reel is prevented from rotating by said locking mechanism, said first drive mechanism rotatably drives said first rotating reel until said tape reaches a preselected position of tension, said stress of said mechanism configured to form said resilient recall aiding in maintaining said tape in said taut state according to said preselected position of tension of said tape, regardless of said conditions of any one of said group consisting of transport, storage, impact, change of temperature, and mechanical stress, wherein any one of a group consisting of said locking mechanism and said first and second drive mechanisms are carried by a plate, said plate being rotatable about an axis of rotation.

14. A tape-consuming apparatus and a replaceable cassette comprising:

said replaceable cassette including:

a tape;

first and second rotating reels each having said tape wound therearound beginning with first and second ends, respectively, of said tape, each of said first and second rotating reels adapted to fit over a spindle of a receiving apparatus when said cassette is inside of and received in the receiving apparatus, and each of said first and second rotating reels including:

a mechanism configured to maintain said tape in a taut state, wherein said mechanism configured to maintain said tape in said taut state includes first drive mechanism configured to rotatably drive said first rotating reel in a first direction, such that when said cassette is outside of and not received in the receiving apparatus, said mechanism configured to maintain said tape in said taut state, maintains said tape in said taut state in a substantially constant manner even during conditions of any one of a group consisting of transport, storage, impact, change of temperature, and mechanical stress; and said tape-consuming apparatus receiving said cassette therein, said tape-consuming apparatus comprising:

a fixed tappet; and a moving tappet configured to actuate, in a direction of disengagement, means of said mechanism configured to maintain said tape in said taut state.

* * * * *